United States Patent [19]

Knöös

[11] 4,327,550

[45] May 4, 1982

[54] THERMODYNAMIC MACHINE

[75] Inventor: Stellan Knöös, Rancho Palos Verdes, Calif.

[73] Assignee: AGA Aktiebolag, Lidingö, Sweden, part interest

[21] Appl. No.: 86,053

[22] Filed: Oct. 18, 1979

[30] Foreign Application Priority Data

Oct. 20, 1978 [SE] Sweden ..... 7810957

[51] Int. Cl.[3] ..... F02G 1/04

[52] U.S. Cl. ..... 60/522; 60/521

[58] Field of Search ..... 60/521, 522

[56] References Cited

U.S. PATENT DOCUMENTS

| | | | |
|---|---|---|---|
| 2,067,453 | 1/1937 | Lee | 60/521 X |
| 3,698,182 | 10/1972 | Knoos | 60/522 |
| 3,889,465 | 6/1975 | Gartner | 60/521 |

FOREIGN PATENT DOCUMENTS

| | | | |
|---|---|---|---|
| 1372813 | 11/1974 | United Kingdom | 60/521 |

*Primary Examiner*—Allen M. Ostrager
*Assistant Examiner*—Stephen F. Husar
*Attorney, Agent, or Firm*—Fraser and Bogucki

[57] ABSTRACT

A hot-gas engine the power output of which is regulatable comprises a cylinder defining variable-volume primary and secondary chambers separated by a piston moving in the cylinder, the movement of which piston is transmitted to an external system extracting the mechanical work produced by the engine. The engine has a heater communicating with the primary chamber, a regenerator communicating with the heater and a cooler containing a supply of working gas at the maximum gas pressure occurring during the work cycle. The engine is provided with valves controlled to pass the working gas to, from and between the primary and secondary chambers in sequential steps. The regulation of the output is accomplished in that during a work-cycle period of increasing primary chamber volume the pressure in the primary chamber is maintained at a high and constant level during a variable fraction of this period, which fraction extends over the work-cycle interval in which a reduction of the power output is obtained for increasing injection time at high and constant pressure. Simultaneously with a reduction of the power output, there is a reduction of the ratio of the maximum and minimum pressures over the work cycle.

39 Claims, 18 Drawing Figures

THERMODYNAMIC MACHINE

BACKGROUND OF THE INVENTION

This invention relates to thermodynamic machines for many different applications, such as hot-gas engines for vehicular applications.

The rising oil prices and the gradual depletion of the world's oil supplies have made the development of high-efficiency engines a matter of great importance. The internal combustion engine which is nowadays most widely used as an automotive engine has far too low an average efficiency to be acceptable in a near future. For example, in private car applications, the common Otto engine or four-stroke carburetor engine usually has an efficiency of less than 10%.

As a consequence of the increasing car density in the world, the problems caused by engine emissions have also become increasingly prominent. In internal combustion engines, work is performed as a result of combustion effected inside the cylinders of the engines through ignition of fuel introduced into the cylinders. The fuel consequently has to satisfy certain specific requirements in order to produce the required work in a satisfactory manner through the combustion process, and the exhaust gases, partly on account of incomplete combustion and partly on account of the presence of various additives in the fuel, have a composition that is environmentally unacceptable (high contents of CO, $NO_x$, hydrocarbons, lead, etc.).

These disadvantages of the present-day internal combustion engines have markedly increased the interest in hot-gas engines during the last few years. In hot-gas engines, gas trapped in a closed system is caused to act on one or more pistons, by being caused to flow to and from one or the other side of the piston and heated and cooled in different suitable sequential steps. Since in the heating step heat is transmitted to the gas from an external arbitrary heat source, the heating can take place in such a manner that the purest possible exhaust gases are produced. The hot-gas engine can operate at a higher efficiency than the so-called Otto engine, and since the heat is produced outside the cylinder or cylinders, such as by external combustion, it is also decidedly more environmentally acceptable and can be run on a large number of different fuels, stored thermal energy or concentrated solar radiation, etc.

Extensive development work on hot-gas engines, primarily of the so-called Stirling type, is currently being carried out in several countries, primarily in the U.S.A., Sweden, Holland and Germany. Studies in this field have been concentrated in the first instance on the so-called double-acting Stirling engine with four pistons in four cylinders. In Stirling engines, gas is transferred between a cold and a warm cylinder containing a moving piston, the transfer taking place via a regenerator and a heater. In the double-acting Stirling engine, the pistons in pairs of interconnected cylinders work in different stages of a work cycle. Thermal net efficiencies (mechanical net power output divided by total applied chemical heat power input) near 40 percent for stationary operating conditions have been demonstrated experimentally with such engines, and temperatures of around 750° C. have then been used in the heater. Even higher efficiencies may be achieved if the materials can be made to withstand higher temperatures. For example, using ceramic materials likely to be available in the future, hot-gas engines of this type can probably operate at efficiencies of around 50 percent or more. The problems associated with the Stirling engines are numerous, however. Among them, mention may be made of problems related to the materials, manufacturing problems and fundamental power-regulating problems.

Automotive engines have to satisfy highly exacting regulating requirements. Preferably, the average efficiency in the case of a varying load profile should also be high. With currently known Stirling configurations it is possible to satisfy the requirement for quick-response regulation, but as a rule it is not possible to satisfy the requirement for high efficiency with partial loads and high average efficiency during the transient processes occurring especially in city driving, that is driving characterized by frequent stops and starts and speed variations. The most widely used method of varying the mean pressure of the working gas in the Stirling engine by means of a compressor and a separate pressure vessel is thermodynamically irreversible, whereby a mechanical net power is consumed because of the transient processes, i.e. the average efficiency of the engine is lower than that achieved in stationary operating conditions. The mechanical design will be complicated and the manufacturing price of the engine will probably be high. The difficulties associated with regulation of the power output are believed to be one major reason why a definite break-through has not yet been achieved for the Stirling engine.

Another type of hot-gas engine is that described in U.S. Pat. No. 3,698,182. In the hot-gas engine of this patent, cooled working gas in a closed container (plenum chamber) is conveyed in different sequences into, out of and between two chambers which are separated by a movable wall common to both chambers and placed between the chambers in the form of a linearly movable or rotary piston. The gas in one chamber, the primary chamber, is hot and the gas in the other chamber, the secondary chamber, is cold. During the period of increasing primary chamber volume and decreasing secondary chamber volume, there occurs at the beginning of the period injection of working gas into the primary chamber, and particularly towards the end of the period discharge, hereinafter termed exhaust, from the secondary chamber takes place. During the period of decreasing primary chamber volume and increasing secondary chamber volume, a transfer of gas from the primary to the secondary chamber occurs. At the time when the engine according to this patent was devised, the possibility of making the secondary chamber smaller than the primary chamber for purposes of power output regulation was not realized. This hot-gas engine has been an object of comprehensive development work for a great many years and in the course of such work, a method for regulation of the power output has been devised which permits high efficiency values even at partial load and transient processes.

The above-explained problem has been solved by constructing the thermodynamic machine according to the invention as set forth in the claims. The invention primarily aims at solving the power-regulating problems in conjunction with the hot-gas engine according to the aforesaid patent, but it is not fully inconceivable that the same regulation principle in one modified form or other may also be usable for other types of hot-gas engines.

SUMMARY OF THE INVENTION

Briefly, the regulating method according to the invention involves keeping the gas pressure at a high and essentially constant level during a variable interval of the period of increasing primary chamber volume, which interval preferably extends from the minimum primary chamber volume to between approximately 40 and 100 percent of full volume, i.e. within that interval of the curve representing the power output versus the injection time which gives a decreasing power output for increasing injection time. If the injection continues after 80 percent of full volume has been attained, the efficiency is noticeably reduced. Therefore, injection should be terminated in practice in the interval of 50 to 90 percent.

In order that power output regulation with high efficiency may be permitted according to this method, the cross-sectional area of the cold secondary chamber is substantially smaller than the cross-sectional area of the hot primary chamber. With an appropriately chosen area ratio, it is possible to ensure that the gas pressure is not sharply reduced during the transfer interval; this is a condition for the success of this method of regulation.

The prior art hot-gas engine had a falling pressure in both the primary chamber and the secondary chamber during the transfer period. This inherently resulted in a loss of energy when regulating towards a lower power output. The obtained curve representing the power output versus the closing time of the injection valve (the point in the work cycle where the injection valve is closed) did not fall towards zero. Although some regulation of the power output was effected by control of the closing time of the injection valve, such regulation took place within the interval where an increase of the power output was obtained for increasing injection time. The power output could only be regulated within a relatively limited power range instead of from full power down to near zero, as in the case of the arrangement according to the present invention.

BRIEF DESCRIPTION OF THE DRAWINGS

A more detailed description of the invention follows below with reference to the accompanying drawings, in which.

DETAILED DESCRIPTION OF THE INVENTION

Figure 1:
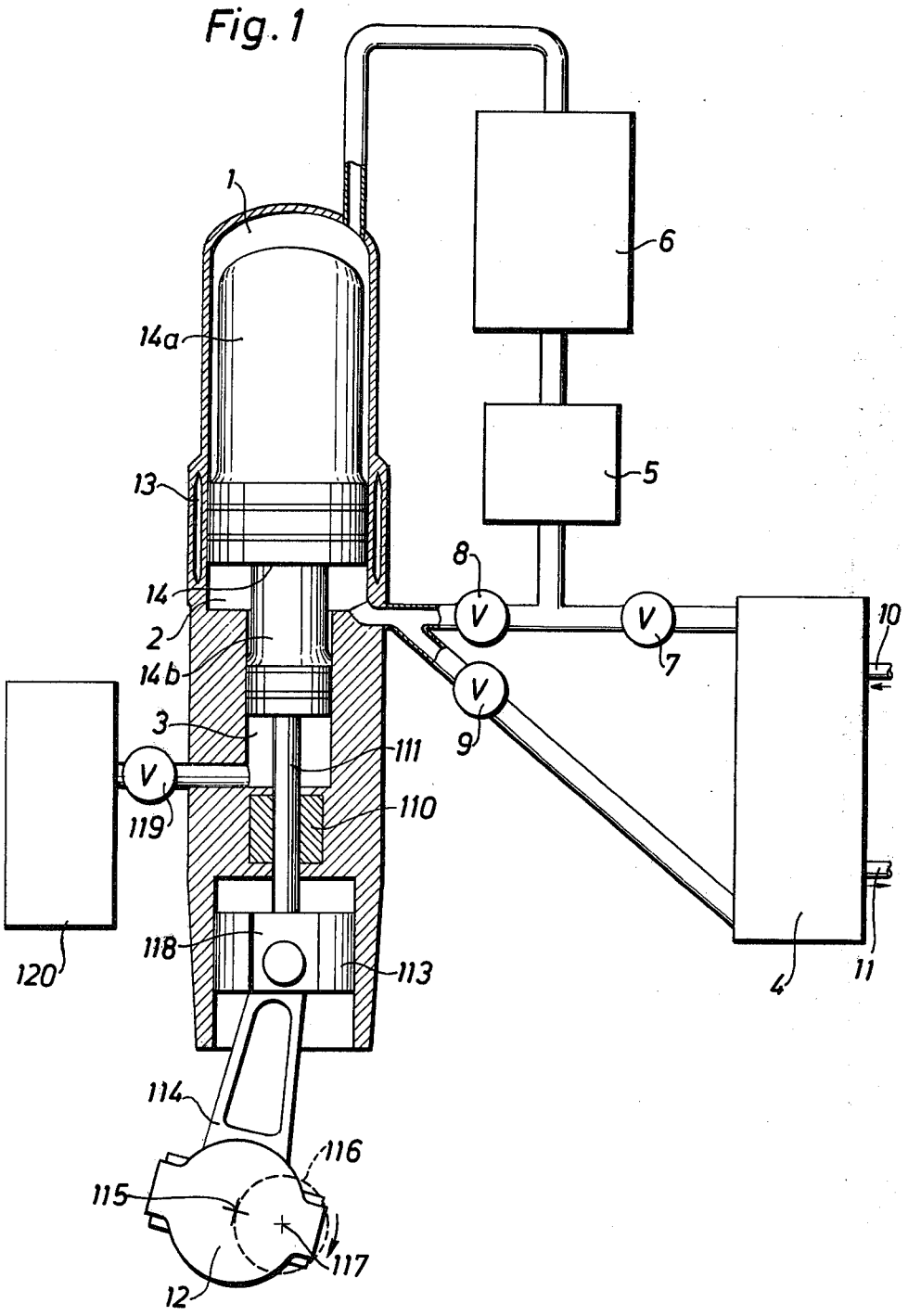
FIG. 1 shows a first embodiment of a machine according to the invention.

In the following description, positional and directional terms such as "upper", "lower", "upwards" and "downwards" refer to the illustrated machines as they appear in the drawings. These terms are used for convenience of description only, as the machines according to the invention can be used in any angular position.

FIG. 1 is a schematic illustration of a first embodiment of the thermodynamic machine according to the invention operating as a heat engine. The illustrated engine is a one-cylinder engine, and in the cylinder a piston 14 delimits an upper primary chamber 1 for hot gas and a lower secondary chamber 2 for cold gas. The piston 14 is a step piston having two parts, of which the upper part **14*a* runs sealingly in a first cylinder portion comprising the two chambers 1 and 2, while a lower part 14*b* of reduced diameter runs sealingly in a second cylinder portion and forms the top wall of a third chamber 3. The gas in the third chamber 3 does not participate in the fundamental process, this chamber being supplied with gas (usually the same kind of gas as that which circulates in the working-gas system) at an average pressure selected so as to result in good force balance and, for example, favorable engine torque versus the angular position of a crankshaft 12 driven in conventional manner by the piston. A high pressure in the chamber 3 yields a positive contribution to the total torque during the upward stroke of the piston. A lower pressure in the chamber 3 reduces the torque during the upward piston stroke but yields an increased contribution during the downward stroke. Ideally, the pressure of the gas in the chamber 3 naturally does not influence the mean value of the torque—and corresponding means mechanical power—but it does influence the interaction of forces in the piston rod and crankshaft and the piston seal between the chambers 2 and 3. The chamber 3 is connected to a storage chamber 120 through a throttle valve 119** which may be variable. The latter is operated when the engine is to be used for dynamic braking.

The lower end of the piston rod 111 (which is guided by a bearing 110) is connected to an oil-lubricated so-called cross-piece piston 113 which runs in a cylinder housing in the same direction as the piston 14. The piston 113 serves to absorb transverse loads exerted by a connecting rod 114 pivoted on the piston 113 and connected to the crankshaft in a conventional manner. The center of the connecting rod bearing (the crank axis) is designated by reference numeral 115, and the race of the bearing round the crankshaft axis 117 is designated by reference numeral 116. The piston 113 is provided with a lateral recess 118 preventing pressure differences over the piston 113.

In the region of the secondary chamber 2 the lower part of the cylinder housing is appropriately cooled by being surrounded here by a flowing coolant 13. By this means, favorable cooling of the lower portion of the piston part 14*a* and the piston ring which runs against the cylinder wall is obtained. The upper portion of the cylinder is shaped such that cooling of the hot gas in the primary chamber 1 is avoided.

The primary chamber 1 and the secondary chamber 2 are included in a closed system containing the working gas, which is preferably hydrogen ($H_2$), although other gases, such as helium, may be used. The system comprises a relatively large plenum chamber 4 which contains gas at the highest gas pressure (typically 5–20 MPa) prevailing in the system. The plenum chamber is designed as a cooling chamber in which the main cooling of the working gas is achieved by means of a coolant circuit within the chamber. The coolant (liquid or gas) flows into the cooler through a conduit 10 and out of the cooler through a conduit 11. The heat exchange should be effective and should take place according to the countercurrent principle, whereby the trapped working gas is cooled as much as possible. It is important for the efficiency of the working process that the gas in the plenum chamber is brought to as low a temperature as possible in relation to the coolant stream (e.g. to 300–320 K).

The closed system also comprises a heater 6 which is directly connected to the primary chamber 1 for heating of the working gas by the external heat source. It should be possible for the gas to be heated in the heater to a high temperature, which for many applications means approximately 1000 K. This temperature is preferably attained through combustion, in the course of which the hot gases produced by the chemical reaction are caused to pass over a flanged pipe through which the working gas passes. The heat may be produced by continuous combustion of any of a large number of different fuels, and the combustion may be made virtually complete. The heating may also be effected by stored latent and/or sensible thermal energy or concentrated solar radiation.

A thermal regenerator 5 is connected in series with the heater. This regenerator is used for temporary accumulation of heat from, and release of the heat back to, the working gas which passes to and fro through the regenerator. The regenerator absorbs heat from the working gas leaving the primary chamber 1 and ideally supplies the same amount of heat to the gas passing through the regenerator into the primary chamber. The regenerator 5 may comprise a metal matrix, sintered material, packed metal fibers, etc.

On the cold side of the regenerator 5 there are conduits with valves by means of which the flow of working gas to, from and between the primary and secondary chambers is controlled. An injection valve 7 is connected in a conduit between the plenum chamber 4 and the regenerator 5. By means of the injection valve, the flow of working gas from the plenum chamber 4 to the primary chamber 1 through the regenerator 5 and the heater 6 is controlled. A transfer valve 8 is connected in a conduit between the regenerator 5 and the secondary chamber 2. The transfer valve is used to control the flow of working gas between the primary and the secondary chambers. An exhaust valve 9 is connected in a conduit between the secondary chamber 2 and the plenum chamber 4 and is used to control the discharge of gas from the secondary chamber 2. The gas flowing through the valves 7 and 8 has a temperature near the temperature of the coolant in the conduits 10, 11, and the gas flowing through the exhaust valve 9 has a temperature which is approximately one hundred degrees higher, i.e. usually below 420 K in the case of a coolant of room temperature (approximately 300 K).

Figure 2A:
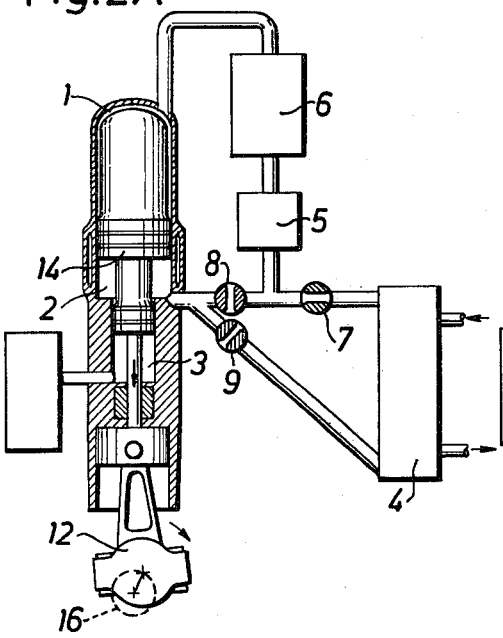
FIGS. 2A–2D shows the machine of FIG. 1 in different positions during a work cycle.
Figure 2B:
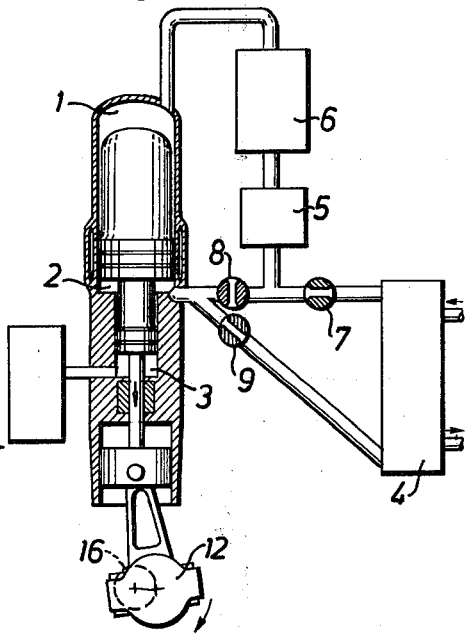
Figure 2C:
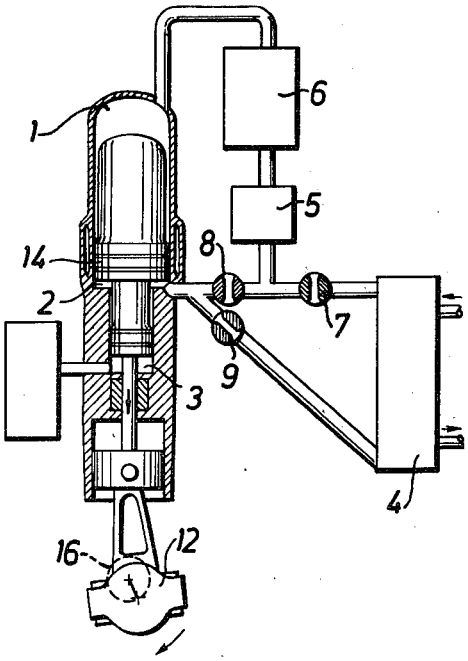
Figure 2D:
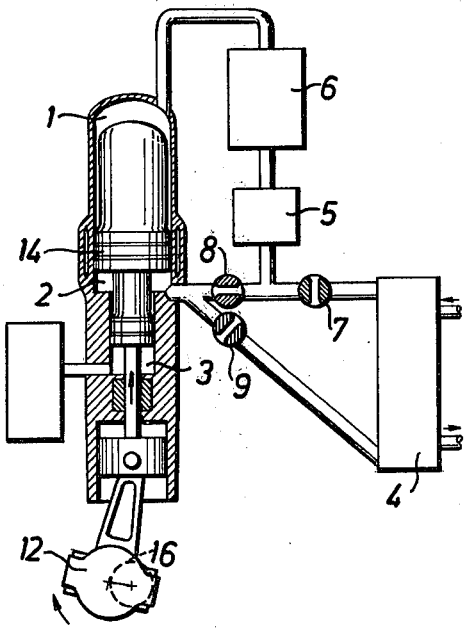
Figure 3:
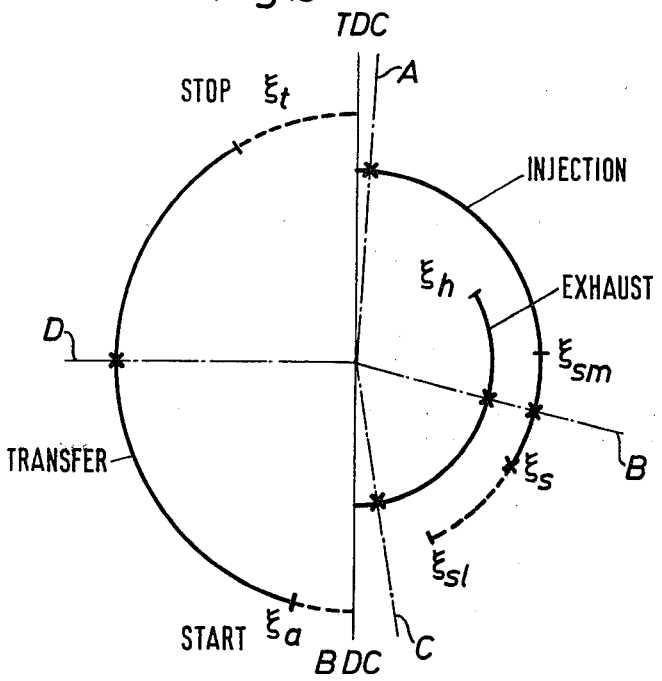
FIG. 3 is a circle diagram showing the open intervals of the control valves of the machine during a work cycle.
Figure 4:
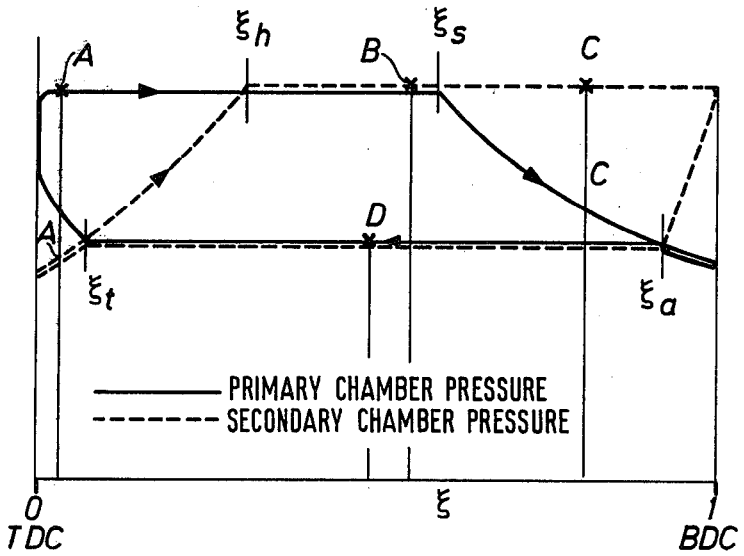
FIG. 4 is a diagram showing the pressure conditions in the primary chamber and the secondary chamber during a work cycle characterized by a relatively high power output.

FIGS. 2A–2D show the positions of the valves during a work cycle, FIG. 3 is a circle diagram showing the intervals during one revolution of the crankshaft 12 in which the valves are open, and FIG. 4 shows the primary and secondary chamber pressures versus the piston position during a work cycle. Representing piston position by $\xi$ (xi), in piston position $\xi=0$ (TDC), the piston is in its topmost position (Top Dead Center), and in piston position $\xi=1$ (BDC), the piston is in its bottommost position (Bottom Dead Center).

FIG. 2A shows the engine in a position in which the piston 14 has just passed its top dead center (TDC). In the circle diagram in FIG. 3, this position is represented by a line A. It is evident that this line only intersects the circular arc designated INJECTION which represents the open interval of the injection valve 7, and thus that in this position only the injection valve is open. In this position, gas flows from the plenum chamber 4 through the regenerator 5 and the heater 6 to the primary chamber 1.

In consequence of the increased primary chamber pressure, the piston 14*a* is acted on by a greater downward force than prior to the injection. The piston is subjected to a downward force produced by the gas in the primary chamber 1 and by upward forces produced by the gas in the secondary chamber 2 and the third chamber 3. The magnitudes of the forces depend upon the momentary gas pressures and the effective piston areas in the respective chambers.

In FIGS. 2A–2D a dashed circle 16 represents the path described by the axis (reference numeral 115 in FIG. 1) of the crank, and the line interconnecting the axis of the crank and the axis of rotation (reference numeral 117 in FIG. 1) of the crankshaft 12 is also shown. The angular position or direction of this line corresponds to the angular position or direction of the line A in FIG. 3. In the pressure diagram in FIG. 4, the piston position in FIG. 2A is represented by a vertical line at A which intersects full and broken lines representing the pressures prevailing in respectively the primary chamber and the secondary chamber. As shown by the full line, the pressure in the primary chamber 1 is approximately equal to the pressure in the plenum chamber 4 when the piston is in this position.

Upon commencement of the work cycle with the piston 14 in its topmost position (TDC), the secondary chamber pressure is substantially lower than the primary chamber pressure which in turn is equal to the pressure in the plenum chamber. This is evident from the bottom left portion of the broken line in the pressure diagram shown in FIG. 4. As the piston moves downwards, the pressure in the secondary chamber 2 rises, and, in this example, when the piston has completed approximately 30 percent of its stroke, the secondary chamber pressure has risen to the plenum chamber pressure. The exhaust valve 9 opens at piston position $\xi_h$ as shown in FIGS. 3 and 4. During a subsequent interval (in this example, but not generally), both the injection valve 7 and the exhaust valve 9 are open, as is also shown in FIG. 2B; this position has been designated by B in FIGS. 3 and 4. Ideally, the piston is subjected to a downward force component during this interval, the magnitude of which will depend upon the amount by which the gas pressure in the third chamber 3 is below the plenum chamber pressure.

The injection valve 7 is then closed when the piston is at the position designated $\xi_s$ in FIGS. 3 and 4. The primary chamber pressure drops during the subsequent piston movement, while the secondary chamber pressure is kept at the same virtually constant level as the plenum pressure. FIG. 2C shows the positions of the valves during a subsequent interval and a position of the piston within this interval has been designated by C in FIGS. 3 and 4. In FIG. 3 a different piston position $\xi_{sm}$ within that interval has also been indicated. If the closing of the injection valve 7 takes place when the piston is in the last-mentioned position, the highest possible power output will be obtained.

When the piston has reached its bottommost position (BDC), the exhaust valve 9 is closed. When the piston then commences moving upwards, the pressure consequently drops in the secondary chamber 2 and is raised slightly in the primary chamber 1, as is evident from the extreme right in FIG. 4. At the position $\xi_a$ of the piston during its upward movement, when the pressures in the primary and secondary chambers are approximately equal, the transfer valve 8 opens and gas is permitted to flow from the primary chamber 1 to the secondary chamber 2. According to the invention, the effective piston area is substantially smaller in the secondary chamber 2 than in the primary chamber 1. For a given mean temperature ratio $T_1/T_2$ in degrees Kelvin for gas in respectively the primary chamber ($T_1$) and the secondary chamber ($T_2$), it is necessary according to ideal theory for the ratio of the effective cross-sectional areas of the primary chamber and the secondary chamber to have a value which is numerically close to $T_1/T_2$ in order that a constant transfer pressure may be achieved during the transfer process.

If, for example, the average gas temperatures are 900 K and 300 K respectively, then appropriately the said piston area ratio for constant transfer pressure must be approximately 3:1 in order that the transfer pressure may be constant. From a purely thermodynamic point of view, the more difficult-to-describe process involving non-constant transfer pressure is then degenerated to the simpler case involving constant transfer pressure, similar to the closed so-called Brayton process. The regenerative processes (the gas flow through the regenerator) then take place at individual constant, although different, pressures. For high average gas pressures, expansions and compressions in both the primary and the secondary chambers are, in the first approximation, nearly adiabatic. FIG. 4 shows an example where the transfer process takes place at virtually constant pressure. FIG. 2D shows the positions of the valves and a momentary position of the engine during the transfer phase. The corresponding piston position has been designated by D in FIG. 3 and FIG. 4.

Figure 5:
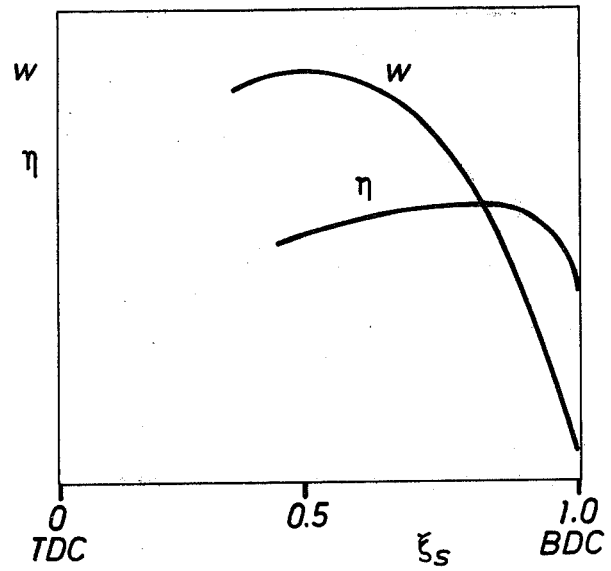
FIG. 5 shows a diagram of the indicated power output and indicated efficiency of a machine according to the invention versus the closing positions of the valves during the first half of a work cycle.

In accordance with the invention, the power output from the engine may be varied by control of the opening and closing of the valves in relation to the phase or angular position of the crankshaft, i.e. the momentary position of the piston. In the first instance, the power output is determined by the phase position at which the injection valve is closed. FIG. 5 is a diagram of the power output W and efficiency $\eta$ versus the parameter $\xi_s$, i.e. the position of the piston during its downward movement at which the injection valve 7 is closed. It is evident from the diagram that the mechanical power output W from the engine decreases from a maximum value reached when the value of $\xi_s$ is between 0.4 and 0.6 and goes to nearly zero when $\xi_s \rightarrow 1.0$. The indicated efficiency is the efficiency which can be calculated from the cyclical pressure curves for the primary chamber 1 and the secondary chamber 2 (indicated power) and the heat flow through the walls of the heater to the working gas. The indicated efficiency shown in FIG. 5 increases slightly when $\xi_s$ increases from a value corresponding to maximum power output W, i.e. typically when $\xi_s$ is between 0.4 and 0.6. For values of $\xi_s$ typically greater than 0.7, this efficiency is reduced and with increasing $\xi_s$ values there is an increase of the relative importance of parasite effects, such as gas friction and heat losses, and a consequent rapid reduction of the ideal mechanical output.

It is, however, possible to utilize the interval 0.7–1.0, although the efficiency falls substantially over the upper portion of this interval, because it is of importance for example in the case of an automobile engine to be able to regulate the power output down to zero; zero power output is obtained if the injection valve 7 is closed only when the piston is very close to its bottom position, i.e. when $\xi_s = 1.0$.

Figure 6:
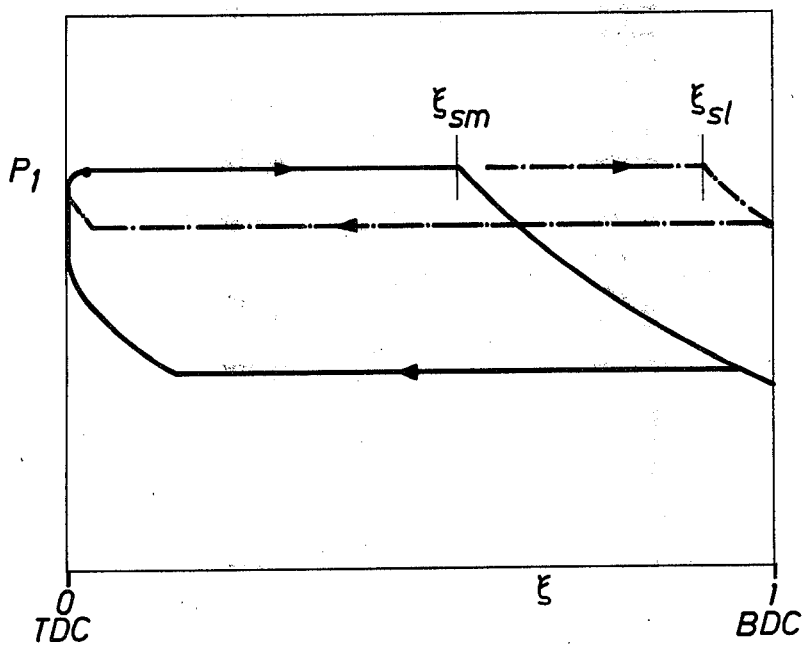
FIG. 6 shows a diagram of the pressure conditions in the primary chamber during two work cycles characterized by different power outputs.

FIG. 6 shows the influence of the regulating method according to the invention on the pressure diagram of the engine. The diagram shows the cyclical pressure variation in the primary chamber for two different $\xi_s$ values, namely, a value $\xi_{sm}$ associated with the highest power output and a value $\xi_{sl}$ associated with a low power output. As is evident from FIG. 6, the smaller value, $\xi_{sm}$, yields a wider pressure diagram with a greater difference between the lowest and highest pressures during a work cycle (higher pressure ratio). The larger value, $\xi_{sl}$, yields a narrower pressure diagram in which the lowest pressure during a work cycle is close to the maximum pressure level (lower pressure ratio), and hence results in a lower mechanical output. Permitted inherently thereby is a higher thermodynamic efficiency on account of correspondingly reduced temperature changes in associated nearly adiabatic expansion and compression steps and a more closely approached ideal process between given temperature levels on the part of the heater and cooler. The phase positions of the crankshaft for $\xi_{sm}$ and $\xi_{sl}$ are also indicated in the circle diagram in FIG. 3. In this diagram, $\xi_s$ designates a phase position which results in a power output from the engine between these extreme values.

The power output can also be partially controlled through variation of the open intervals of the transfer valve 8. The opening of this valve, i.e. the parameter START TRANSFER, $\xi_a$, is chosen to take place near the piston position $\xi = 1.0$ and is preferably chosen at the point when during the upward movement of the piston the pressure in the secondary chamber 2 has dropped to the pressure prevailing in the primary chamber 1. The value of $\xi_a$ is dependent upon the values of so-called dead-space volumes in the system. Closing of the transfer valve, i.e. the parameter STOP TRANSFER, $\xi_t$, can be effected at a position within relatively wide limits between two extreme values, namely, a maximum value yielding full recompression in the primary chamber 1 to the plenum pressure when the piston has reached its top position ($\xi = 0$) and a minimum value $\xi_t = 0$. As a rule, good results are obtained if the actual $\xi_t$ value is chosen in the interval 50 to 100 percent of the maximum value. It should nevertheless be observed that the maximum $\xi_t$ value, which corresponds to full recompression of gas in the primary chamber 1 to plenum pressure, yields the highest efficiency but at the same time a lower specific power output.

When a high power output is desired, the $\xi_t$ value is so selected that only partial recompression of gas in the primary chamber 1 is brought about. When, on the other hand, high efficiency is essential instead of high specific power output, full or virtually full recompression should be resorted to.

With regard to the control of the opening position $\xi_h$ of the exhaust valve 9, which in point of fact ideally must open when the pressure in the secondary chamber 2 has increased exactly to the pressure level prevailing in the plenum chamber 4, it may be mentioned that the actual value of $\xi_h$ for a given engine geometry is primarily dependent upon the choice of the parameter $\xi_t$. It is possible to choose the parameter $\xi_h$ uniquely as a function of $\xi_s$ for an engine working with a fixed ratio of the heater and cooler temperatures, provided that $\xi_t$ is also chosen as a function of $\xi_s$.

However, for a sophisticated and highly efficient engine, it is more reliable and therefore appropriate to base the control of the opening position $\xi_h$ of the exhaust valve on a differential pressure measurement. The comparative measurement of the pressures in the plenum chamber 4 and in the secondary chamber 2 is performed primarily during the first portion of the downward movement of the piston. When the pressure in the secondary chamber 2 slightly exceeds the plenum chamber pressure, the exhaust valve 9 opens. This can be accomplished in several ways, for instance by means of electronic indication and control in standard manner. Naturally, the exhaust valve 9 may also be constructed as a check valve so that it opens completely by itself when the pressure in the secondary chamber 2 exceeds the plenum chamber pressure by a certain amount. High demands for speed and reliability and nevertheless valid. The check valve method as a rule does not permit sufficient speed in the case of a sophisticated engine.

The valves are thus preferably controlled in accordance with the angular or phase position of the crankshaft connected to the piston, as is shown in FIG. 3.

It is obvious that the valves can be mechanically connected to the crankshaft so that they are controlled directly by the angular or phase position of the latter. It may, however, be more advantageous to sense the position of the crankshaft electronically, for example by means of an angle transducer attached to the shaft. Microprocessor technology frequently utilized for various control and indicating purpose in modern motor vehicles may be applied here to adjust the control of the closing of the injection and transfer valves respectively, in accordance with the actuation of the "accelerator pedal", i.e. in accordance with different wanted power outputs. The microprocessor can also compute the angular or phase position of the crankshaft at which the exhaust valve 9 is to be opened, either depending upon the aforesaid differential pressure or depending upon the angular or phase position at which the closing of the injection and transfer valves takes place and the difference between the temperatures of the primary and the secondary chambers. Computation of the exhaust valve closing position can also be performed on the basis of a directly recorded ratio of the plenum chamber pressure to the minimum secondary chamber pressure or of the plenum chamber pressure to the secondary chamber pressure for any given $\xi$ value during the compression phase for gas in the secondary chamber.

The valves 7, 8, 9 and their variable opening and closing positions as expressed in terms of, for example, the angular or phase position of the engine crankshaft can be controlled by means of known mechanical, hydraulic, electro-mechanical or electro-magnetic devices. The valve types which are particularly appropriate in this context are piston or plane slides, rotating valves, seat valves or combinations of these.

Figure 7:
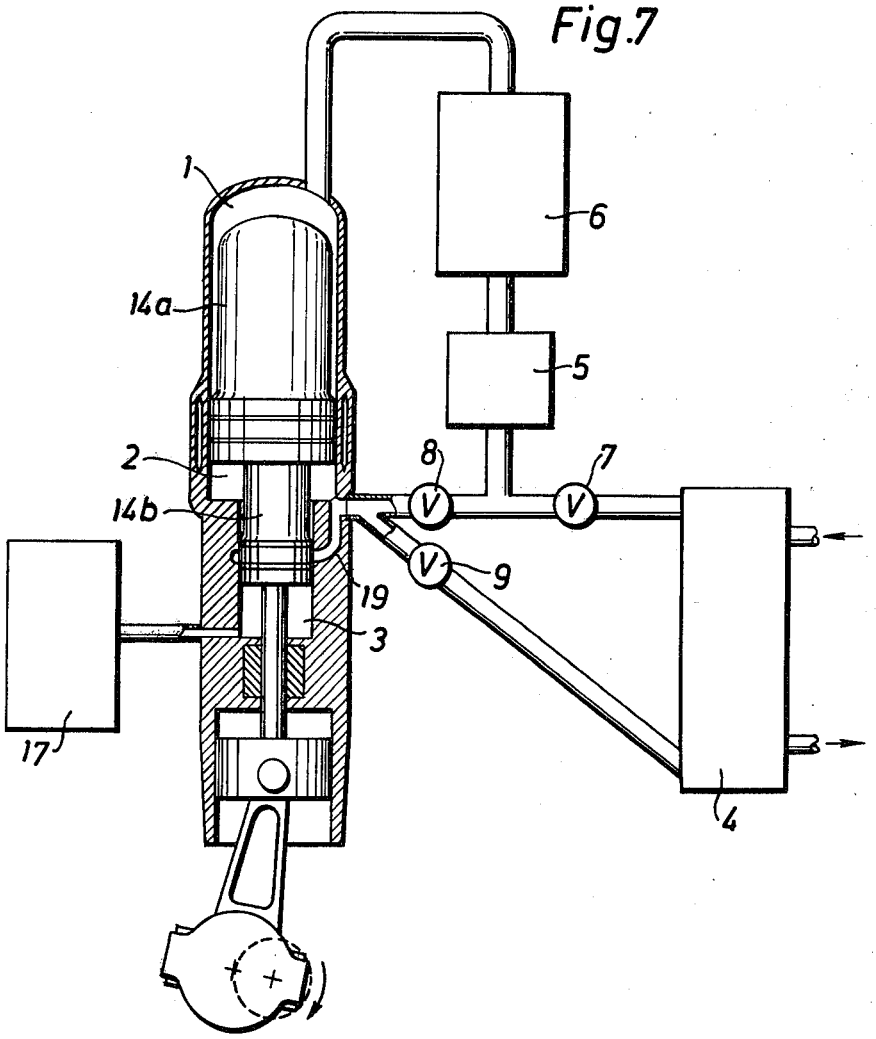
FIG. 7 shows a second embodiment of the machine according to the invention.
Figure 8:
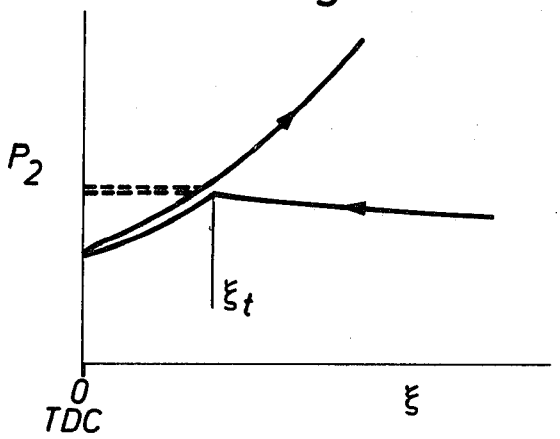
FIG. 8 shows a section of a pressure diagram for the secondary chamber of the embodiment illustrated in FIG. 7.

FIG. 7 shows a second embodiment of the engine according to the invention. As evident from the left portion of FIG. 8, the gas pressure $P_2$ in the secondary chamber drops at the piston position $\xi_t$ after the transfer valve 8 has closed. If the chamber 3 is provided with gas at the same pressure as during the transfer period, i.e. approximately the lowest pressure of the work cycle, the decreasing secondary chamber pressure can be avoided if the chambers 2 and 3 are interconnected through a shorting passage 19. This passage allows free passage of gas when it is uncovered by the piston only during a certain fraction of the piston movement, namely symmetrically, when the piston is in the vicinity of the top dead center. The effect of such an uncovering of the passage between the chambers 2 and 3 with an associated extra volume 17 is that the pressure in the secondary chamber 2 is maintained at the constant level shown by a broken line in FIG. 8, instead of undulating in the manner shown by the full line as would otherwise be the case. Ideally, the pressure undulation is unharmful in itself, but in practice, particularly at low gas pressures, a pressure undulation may cause an unwanted non-reversible heat exchange between the working gas and the walls of the secondary chamber 2 with an increased compression work as a possible consequence. Pressure undulation results in a somewhat higher piston ring load. Since the engine runs at a speed which often amounts to 4000 revolutions per minute, the engine will complete several cycles during every change of the power output. If the extra volume 17 connected with the chamber 3 is moderately large, i.e. sufficiently large to just provide uniform gas pressures in the chamber 3 during a cycle, the gas pressure in the chamber 3 is automatically adjusted to the prevailing transfer pressure after a number of completed engine cycles. A flywheel mounted on the crankshaft contributes to distribution of the engine torque evenly over a complete crankshaft revolution.

Figure 9:
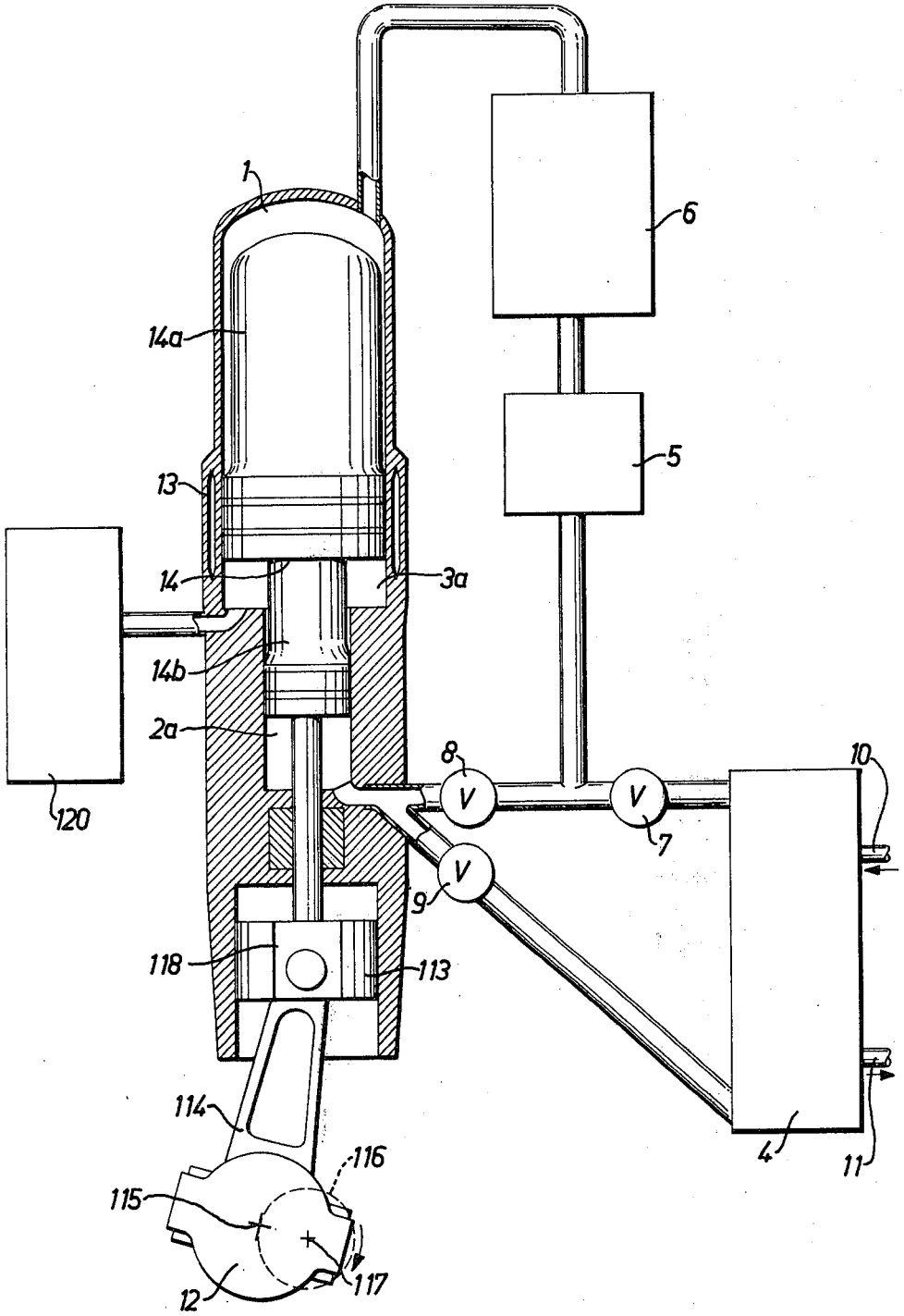
FIG. 9 shows a third embodiment of the machine according to the invention.

Instead of being disposed under the secondary chamber as in the embodiments described above, the chamber 3A in the cylinder can be placed between the primary chamber 1 and the secondary chamber 2A as shown in FIG. 9. If the gas pressure in the chamber 3A is the same as the plenum pressure, the upper piston rings are unloaded ($\Delta p=0$) during the injection phase, and the lower piston rings are unloaded during the exhaust phase. The load direction for both groups of piston rings is always the same, which may be a decided design advantage.

If the pressure in the chamber 3A is chosen at the other extreme value, i.e. the lowest during the transfer process or the pressure prevailing in the secondary chamber 2 when $\xi=0$, then for similar reasons both groups of piston rings will be unloaded during the transfer process.

Figure 10:
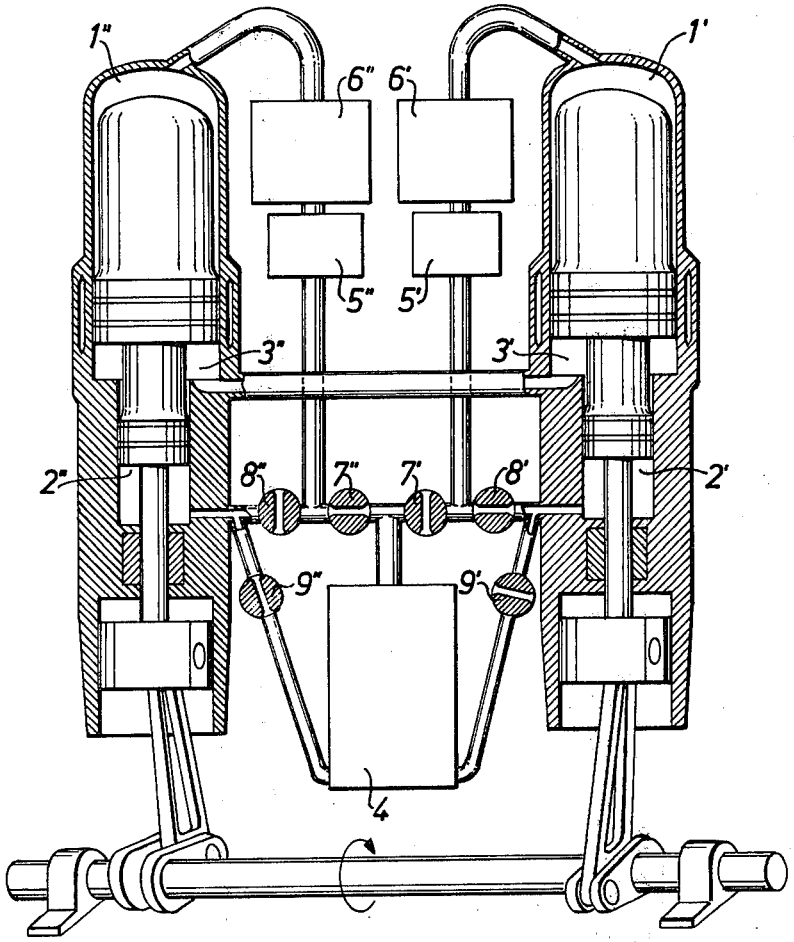
FIG. 10 shows a fourth embodiment of the machine according to the invention.

FIG. 10 shows a two-cylinder hot-gas engine according to the invention, in which the pistons work with a phase difference of 180°. In FIG. 10, chambers 3' and 3'' are interconnected, and since the pistons work in phase opposition, the co-acting volume is constant as is the pressure in these chambers without application of a large extra volume or without the chambers being connected to the plenum chamber 4.

Figure 11:
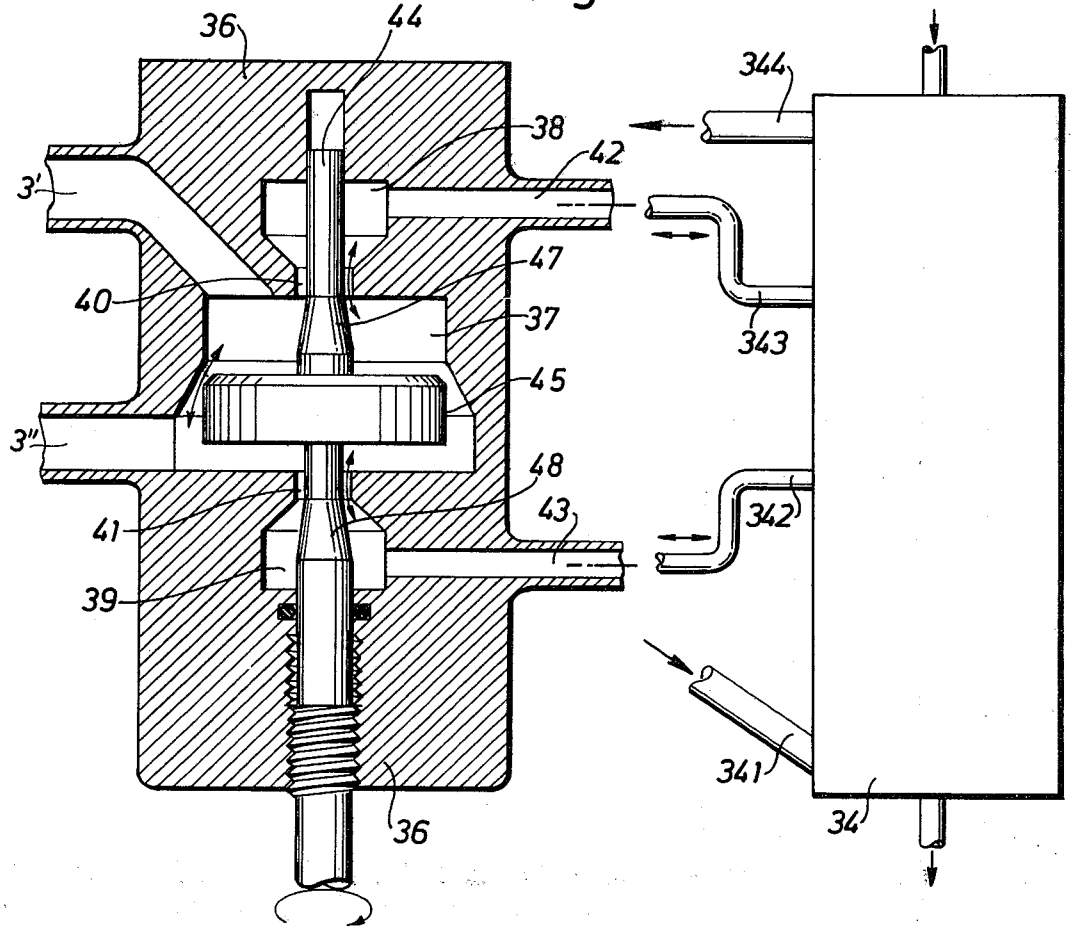
FIG. 11 shows an extra attachment for dynamic braking by the machine.

FIG. 11 shows a version of a valve for dynamic braking by means of the engine, i.e. for causing the engine to supply the retarding force. Using the illustrated throttle device 36, a stepless gentle dynamic braking action and, at the same time, cooling in the plenum chamber is obtained. The throttle device 36 comprises a valve chamber 37, which has two successive circular cylinder-shaped sections of different diameters and an intermediate frusto-conical section. The conduits from the chambers 3' and 3'' are connected respectively to ones of the cylinder-shaped sections. In series with the upper cylinder-shaped section of the chamber 37, there is a further cylindrical chamber 38 of small diameter in relation to the chamber 37 and comprising a conical section and a narrow passage 40 opening towards the chamber 37. The conical section of the chamber 38 tapers towards the passage 40 and the chamber 37. In series with the lower cylinder-shaped section there is yet another cylindrical chamber 39 comprising a narrow passage 41 opening into the chamber 37. The portion of the chamber 39 which is adjacent the chamber 38 tapers conically towards the passage 41.

A pipe 42 runs from the upper chamber 38 to an inlet 343 of the plenum cooler 34 and a pipe 43 runs from the lower chamber 39 to an inlet 342 of the plenum cooler. The inlet pipes 342 and 343 are spaced from the conduit 344 through which injection occurs to the chamber 1 and the conduit 341 through which gas flows from the chamber 2 during the exhaust phase. The pipes 342 and 343 should not, moreover, be located too closely to one another, for in this case the hot gases coming from one pipe may heat up the area around the other pipe, resulting in insufficient cooling. In FIG. 11 they are shown positioned centrally but spaced by a certain distance.

A valve body disposed in the chambers 37, 38 and 39 can be continuously adjusted longitudinally to different positions. This valve body is provided with a cylinder-shaped element 45, which is placed in the lower part of the chamber 37 and has a slightly larger diameter than the upper section of the chamber 37 and a conical chamfer facing the upper section of the chamber. A part of the valve body 44 having a smaller diameter than the narrow passage 40 extends through that passage, and in the chamber 37, a valve body part 47 enlarges conically to to a larger diameter than the passage 40. Similarly, a part of the valve body having a smaller diameter than the passage 41 extends through that passage. A further part 48 of the valve body is conically enlarged towards the chamber 39 to a larger diameter than the passage 41. In FIG. 11 the valve body is longitudinally displaceable by turning it, but it is obvious that other displacement mechanisms, for example hydraulic, can be used. With the valve body in its lowest position the passage 40 and the passage between the two cylindrical sections of the chamber 37 are unobstructed while the passage 41 is blocked by the element 45, hereinafter referred to as the main valve element. The gas in the chambers 3' and 3'' then flows between the chamber sections, and the pressure is maintained at the plenum chamber pressure through the open passages 40, 38, 42, 343 to the plenum chamber 34. When the valve body is moved upwards, the passage between the chambers 3' and 3'' is blocked by the main valve element 45. The gas is then forced through the narrow passages 40 and 41 to the plenum chamber 34. As the gas is forced through the narrow passages it is heated and since the pipes 42 and 43 are also narrow, hot gas flows through these to the plenum chamber where it is cooled. A continuous control of the braking action is obtained by gradually moving the valve body upwards, whereby the conical parts 47 and 48 increasingly block the passages 40 and 41, causing an increasing load to be applied to the engine. The whole thing works as if mechanical power were taken from the engine crankshaft and converted into heat which is dissipated by cooling in the plenum chamber.

It should be noted that before engine braking is exercised using the throttle valve shown in FIG. 11, valves 7, 8 and 9 are caused to be actuated at the position corresponding to minimum power output. This means that the injection valve 7 is closed only when the piston has reached its bottom position, i.e. when $\xi_s \rightarrow 1.0$. This ensures that the cooler is already at low load, as is evident from the diagram in FIG. 6 from which it may be seen that at this value of $\xi_s$ the plenum pressure is maintained in the entire system throughout the work cycle. Thus, the working-gas circuit comprising the primary chamber, the secondary chamber and the plenum cooler requires only minimum cooling, enabling the plenum cooler to be used for the dissipation of braking heat.

Figure 12:
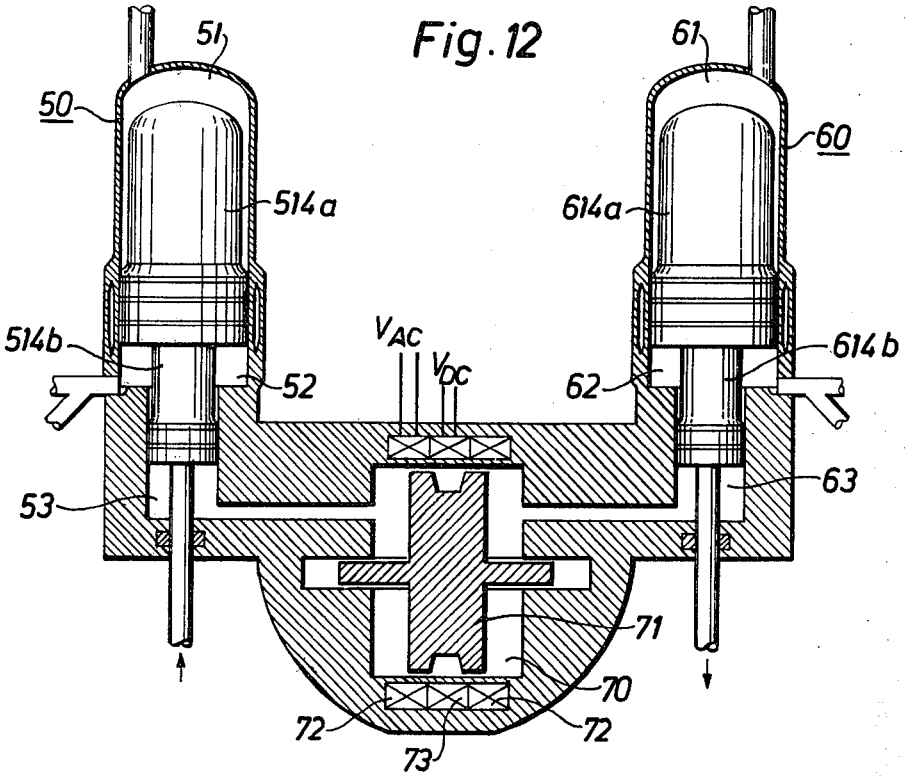
FIG. 12 shows an alternative device for power take-off.

In certain applications, it may be appropriate, instead of using a crankshaft, to take out the power by means of the gas which flows back and forth between the chambers 3' and 3'' in a two-cylinder engine. FIG. 12 shows an embodiment for achievement of this. In this embodiment, an additional chamber 53 provided in the engine cylinder at the lower part of the step piston **514*b* is connected to an additional chamber 63 provided in the engine cylinder 60 at the lower part of the step piston 614*b* through a chamber 70 which contains the moving part of a linear electrical generator, a so-called linear alternator. The movable part 71 is a piston which varies the strength of a magnetic field and induces electromagnetically a useful alternating current. When electromagnetically loaded, the alternator will encounter a mechanical phase shift from the unloaded condition. Referece numeral 73 designates the direct-current winding of the alternator which is energized by a direct-current source, $V_{DC}$. Reference numeral 72** designates the alternating-current windings of the alternator from which the induced alternating-voltage is taken out.

Multi-cylinder hot-gas engines according to the invention are possible. One- and two-cylinder engines will likely attract the most interest for conventional applications such as for example automobile engines. The number of engine components can then be kept low in comparison with equivalent double-acting four-cylinder Stirling engines. The torque of the two-cylinder engine is naturally not as uniform as that of the double-acting four-cylinder Stirling engine, but is nevertheless fully sufficient for the majority of applications. The two-cylinder engine with a phase difference of 180° can easily be very accurately balanced.

Figure 13:
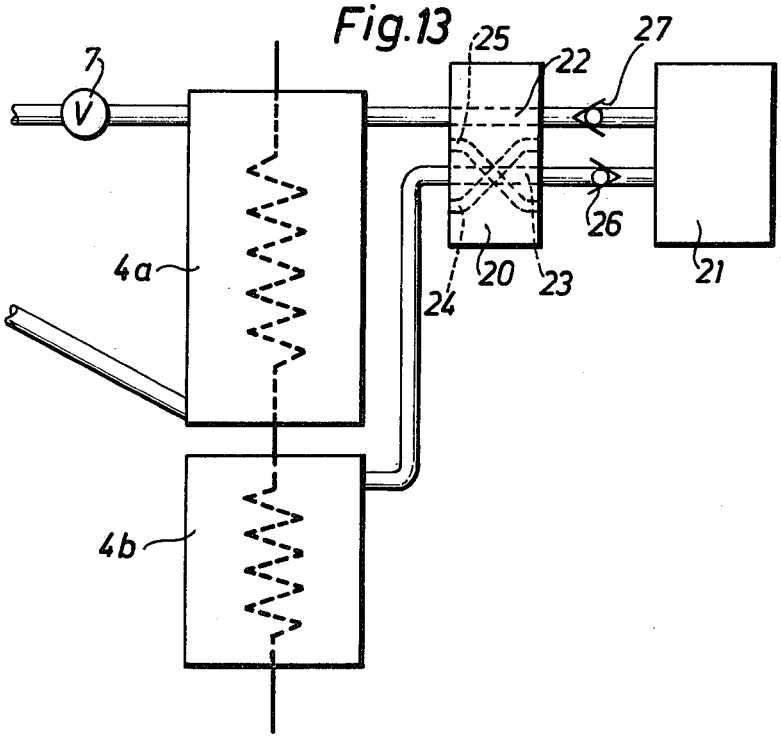
FIG. 13 shows a variant of a plenum unit.

FIG. 13 shows a system having an additional plenum chamber **4*b* connected to the plenum chamber 4*a*. The two plenum chambers are interconnected by gas conduits containing a control valve 20 which can be set to two positions. In addition, a compressor 21 is connected to the gas conduits. The plenum chambers 4*a* and 4*b* are subjected to different pressures, and gas can be conveyed from the chamber 4*a* to the chamber 4*b* through pumping by the compressor 21 when the valve 20 is in the illustrated position in which passages 22 and 23 extend straight through the valve so that the gas flows from the chamber 4a through check valve 27, compressor 21 and check valve 26 to the chamber 4b. When the valve 20 is switched to its second position, passages 24 and 25 running crosswise in the valve form part of the conduits extending from the chambers 4a and 4b to the compressor 21, so that upon pumping by the compressor 21, gas is conveyed from the chamber 4b to the chamber 4a through check valve 27, the compressor 21 and check valve 26. Increased maximum pressure in the entire working-gas system increases the total power output of the engine, and conversely a reduced maximum pressure decreases the power output. The device shown in FIG. 3** thus permits slow power regulation.

Figure 14:
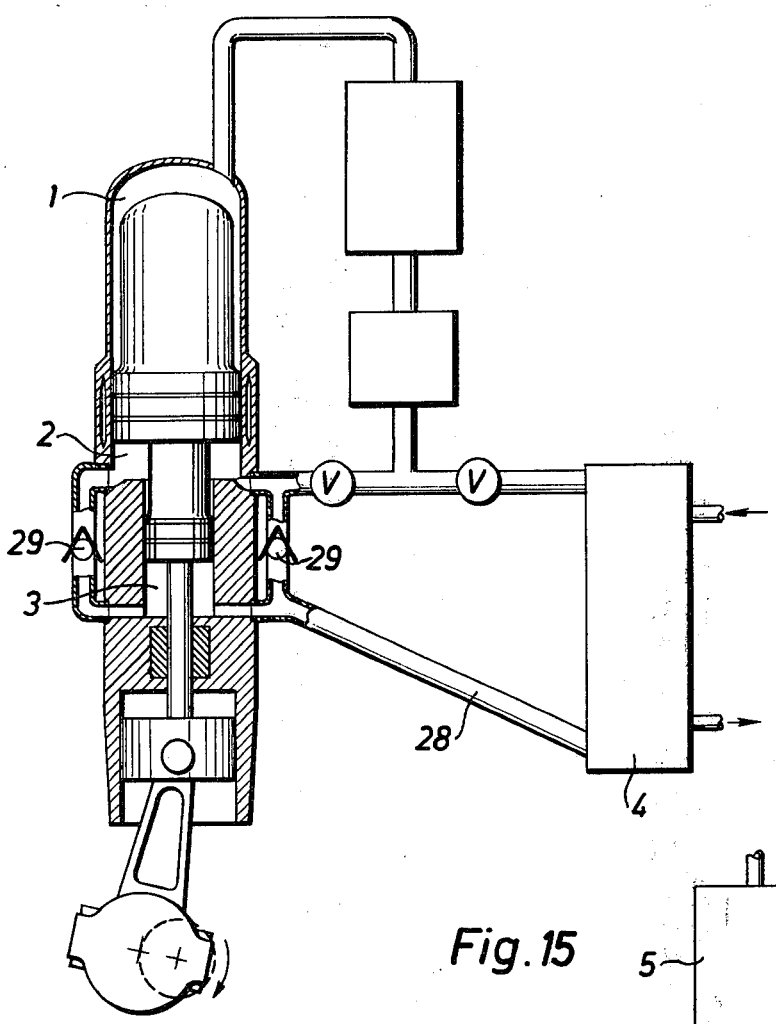
FIG. 14 shows a fifth embodiment of the machine according to the invention.

FIG. 14 shows yet another embodiment of an engine according to the invention. In this embodiment, the additional chamber 3 is connected to the plenum chamber 4 through a conduit 28 so as to be subjected to the pressure of the plenum chamber. The secondary chamber 2 is connected to the additional chamber 3 through several conduits, each containing a self-opening check valve 29. The valves 29 can be constructed as a plurality of small, rapidly opening and rapidly closing units, which for example can be made as metal membranes and preferably open symmetrically into the chamber 3.

Figure 15:
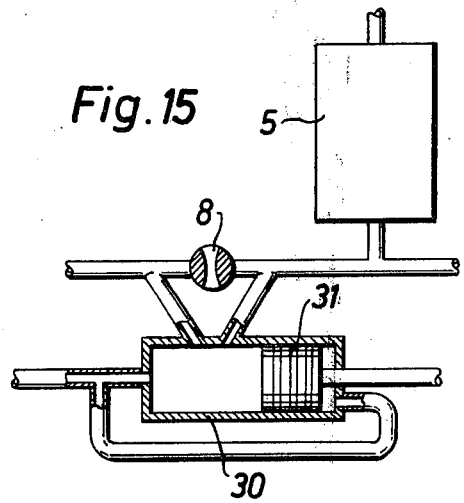
FIG. 15 shows a start valve.

Start of the hot-gas engine according to the invention is easily accomplished by short-circuiting the primary chamber 1 and the secondary chamber 2 to the plenum chamber. This may appropriately be done by means of the valve 30 shown in FIG. 15, in which two conduits are connected across the transfer valve 8 and a third conduit is connected to the plenum chamber 4. Upon opening of the valve, a piston 31 in the valve is moved to the right in the figure and uncovers the short-circuiting conduits. Upon closing of the valve, the piston is moved to the left and then closes the short-circuiting conduits. Several other valves having the same valve function as the illustrated valve can of course be used for the starting. Upon starting, the valve 30 is thus opened and the engine is driven by means of a low-power starter serving to overcome mechanical friction and to aid the small gas forces at the moment of starting. When the heater 6 and the regenerator 5 have reached a certain temperature, the valve 30 may be closed, after which the engine is self running. Other conventional starting methods may also be applied but usually are more demanding on the starter motor.

Several different modifications may be made within the scope of the invention. It should be noted that all the illustrated embodiments of the invention can be made multi-cylinder, although control takes place for each cylinder separately. It should be particularly noted that the system shown in FIG. 10 with third chambers 3' and 3'' directly connected to each other can be used without further ado for engines with more than two cylinders if the various cylinders incorporated in the system work in such relative phase positions that the total volume of the third chambers is constant throughout the work cycle.

What is claimed is:

1. A method of regulating a hot gas engine to generate a variable/mechanical power output in which the working medium is transferred between variable volume hot and cold gas chambers that vary cyclically in volume in inverse fashion, the transfer taking place during volume contraction of the hot gas chamber, the method comprising the steps of:

injecting working medium into the hot gas chamber at the start of expansion of the volume to maintain the pressure substantially constant at a working medium pressure for a selectively controllable interval during volume expansion of the hot gas chamber; and maintaining a selected transfer pressure relationship at substantially constant pressure in the hot and cold gas chambers during a substantial part of the volume contraction of the hot gas chamber, the ratio between transfer pressure and working medium pressure being variable up to substantially unity to provide variable power output including substantially zero work output.

2. The method as set forth in claim 1 above, wherein the step of injecting working medium establishes a maximum pressure that is substantially constant, during the interval of injection, and the interval of expansion of the hot gas chamber volume following injection determines the transfer pressure.

3. The method as set forth in claim 2 above, wherein the injection of working medium occurs from substantially minimum chamber volume to between 40 and 100 percent of the full volume of the hot gas chamber.

4. The method as set forth in claim 3 above, wherein the change of the absolute volume of the hot gas chamber occurs at a higher rate than the inverse change of the absolute volume of the cold gas chamber, so as to maintain the minimum pressure substantially constant during the transfer phase.

5. The method as set forth in claim 4 above, wherein the ratio of the change rates of the volumes corresponds to the ratios of the mean absolute temperatures of the gases in the hot gas and cold gas chambers.

6. The method as set forth in claim 3 above, including in addition the step of maintaining the pressure of the working medium in the cold gas chamber no greater than the pressure maintained in the hot gas chamber during expansion thereof.

7. The method as set forth in claim 6 above, further including the step of controlling the duration of the transfer step relative to the cyclic volume variation such as to control the maximum pressure at the time of recompression, whereby adjustments may be made in work output and efficiency.

8. The method of operating a hot gas engine, having a hot gas chamber and a cold gas chamber of cyclically variable volumes and interconnected by a regenerator, so as to provide adjustable output power with high efficiency throughout the operating power range, comprising the steps of:

transferring working medium from the hot gas chamber to the cold gas chamber through the regenerator at a substantially constant transfer pressure during a transfer portion of the working cycle; and injecting working medium into the hot gas chamber through the regenerator at a selected working pressure higher than the transfer pressure for a variable time interval in the remainder of the working cycle, the longer the interval of injection the higher is the transfer pressure level, whereby work output is decreased by increasing the ratio of the transfer pressure to the working pressure, and the work output may be decreased substantially to zero by increasing the ratio to substantially unity.

9. The method of claim 8 above, wherein cool working medium is heated after the regenerator and is injected into the hot gas chamber at the selected working pressure.

10. The method of claim 9 above, including the further step of extracting working medium from the cold gas chamber during contraction thereof when the pressure therein is at the selected working pressure such that the working pressure is not exceeded.

11. The method of claim 10 above, including the step of controlling the duration of the transfer portion of the working cycle so as to alter the initial recompression pressure of the hot gas chamber.

12. In a thermodynamic machine having hot and cold chambers of cyclically variable volume defined by piston-cylinder combinations intercoupled to pass a working medium through a regenerator in injection and transfer portions of the cycles, the combination comprising:

plenum means for providing working medium at a predetermined working medium pressure;

working medium injection means for coupling working medium from the plenum means to the hot chamber through the regenerator for an interval of controllable duration up to 100% during expansion of the hot chamber volume in the injection portion of the cycle, to maintain the hot chamber pressure substantially constant at the working medium pressure for the interval of injection and to decrease the hot chamber pressure level to a selectively controllable lower level for transfer of working medium from the hot chamber during the transfer portion of the cycle;

means associated with the chambers for maintaining the transfer pressure substantially constant in the hot and cold chambers, at a pressure level determined by the length of the injection interval, during the transfer portion of the cycle;

and wherein the ratio between the effective cross-sectional areas of the pistons is substantially equal to the ratio of the mean working temperatures of the chambers.

13. The invention set forth in claim 12 above, further including exhaust valve means for coupling the cold chamber to the plenum means for a controllable interval during expansion of the volume of the hot gas chamber.

14. The invention as set forth in claim 13 above, wherein the exhaust valve is opened to couple the cold chamber to the plenum means when the cold chamber pressure is substantially equal to the working medium pressure during expansion of the hot chamber.

15. A thermodynamic engine having at least a pair of variable volume chambers varying cyclically in opposite senses, a first of the chambers of the pair being a hot chamber and the second of the chambers of the pair being a cold chamber, the chambers of a pair being interconnected via a regenerator, and the machine cycle including an injection portion in which the hot chamber volume is expanding and a transfer portion in which the hot chamber volume is contracting, the machine comprising:

means coupled to the hot chamber for injecting hot working medium into the hot chamber at a predetermined working pressure for a selectively variable part of the injection portion of the engine cycle;

means coupled to the cold chamber for exhausting working medium therefrom at the predetermined working pressure during a controllable part of the engine cycle in which the cold chamber volume is contracting; and means coupling the hot chamber to the cold chamber and maintaining a substantially constant common pressure in both chambers during a principal part of the transfer portion of the cycle.

16. The invention as set forth in claim 15 above, wherein said means for injecting a hot working medium comprises plenum means maintaining working medium at the predetermined working pressure and injection valve means coupled to the regenerator, and heater means coupling the regenerator to the hot chamber, and wherein said means for exhausting working medium comprises exhaust valve means coupling the cold chamber to the plenum means.

17. The invention as set forth in claim 16 above, wherein said means maintaining substantially constant pressure comprises transfer valve means coupling the hot and cold chambers and means providing a selected volumetric change ratio between the hot and cold chambers.

18. The invention as set forth in claim 17 above, wherein the selected volumetric change ratio is substantially equal to the ratio between the absolute mean temperatures of the hot and cold chambers.

19. A regenerative thermodynamic machine working with a compressible working medium, comprising at least one primary chamber partly limited by a movable first wall and at least one secondary chamber which is partly limited by a second movable wall rigidly connected with the first wall, the movable walls being subject to control during exchange of mechanical work with an external system and the chambers being connected to a closed working-medium system containing the working medium and including a heater connected with the primary chamber for heating of the working medium, a regenerator connected with the heater, a cooler connected to an external coolant system and containing a supply of working medium at the maximum working-medium pressure occurring during the work cycle, an injection valve disposed in the working-medium system between the cooler and the primary chamber, a transfer valve disposed in the working-medium system between the primary and the secondary chambers, and an exhaust valve disposed in the working-medium system between the secondary chamber and the cooler, characterized in that the ratio of the cross-sectional area of the first wall to the cross-sectional area of the second wall is substantially the same as the ratio of the mean gas temperatures prevailing during operation in the primary chamber and the secondary chamber respectively, and in that mechanical power output from the machine is regulatable through control of the injection valve such that during a period of increasing primary chamber volume, the pressure of the working medium contained in the primary chamber is kept at an essentially constant level during a variable fraction of the period of increasing primary chamber volume extending from the beginning of said period to a closing interval near the end of said period in which increasing injection time results in reduced power output, said constant level being high in relation to said maximum working-medium pressure, the ratio of the maximum pressure to the minimum pressure over the work cycle being arranged to be decreased simultaneously with power output reduction.

20. A machine according to claim 19, characterized in that the ratio of the cross-sectional area of the first wall to the cross-sectional area of the second wall is approximately 3:1.

21. A machine according to claim 19, characterized in that the injection valve is arranged to open at the instant of minimum primary chamber volume and in that the interval for closing of the injection valve lies between the instants at which the primary chamber volume is 40 percent and 100 percent, respectively, of the maximum primary chamber volume.

22. A machine according to claim 19, characterized in that an exhaust valve is coupled in the exhaust line from the secondary chamber and is arranged to open during a period of decreasing secondary chamber volume when the pressure in the secondary chamber has reached a predetermined level.

23. A machine according to claim 19, in which during a period of decreasing primary chamber volume the secondary chamber volume increases and the transfer valve disposed between the primary and the secondary chamber is open at least during a fraction of this period, so that gas is transferred from the primary to the secondary chamber, characterized in that the transfer valve is open from near the beginning of the said period and in that the closing interval for the transfer valve is variable between an instant associated with a position of the movable first wall delimiting the primary chamber which gives full recompression in the primary chamber to the pressure level prevailing during the first portion of the period of increasing primary chamber volume and an instant associated with the position of the movable first wall delimiting the primary chamber corresponding to minimum primary chamber volume.

24. A machine according to claim 19, characterized in that an additional container for working medium is connected to the working-medium system through a compressor and in that working medium can be controllably conveyed by the compressor in the desired direction between the working-medium system and the additional container, whereby the maximum pressure in the working-medium system is regulatable.

25. A machine according to claim 19, characterized in that a third chamber is provided which contains a compressible medium at essentially constant mean pressure during a complete work cycle in normal operation and is delimited by a movable wall rigidly connected to the movable first and second walls delimiting the primary and secondary chambers.

26. A machine according to claim 25, characterized in that a passage between the third chamber and the secondary chamber is arranged to be opened during a short interval of the work cycle in which the secondary chamber is at maximum or nearly maximum volume.

27. A machine according to claim 25, characterized in that the machine is operable for absorption of mechanical energy by a control valve device which upon braking restricts to a selected degree a passage connecting the third chamber with a buffer volume comprising a cooler.

28. A machine according to claim 25, in which the machine comprises several units, each including primary and secondary chambers with associated control valves and working-medium systems and a third chamber, characterized in that a buffer volume for any one of the third chambers comprises the other third chambers and in that the units operate in such relative phase positions that the total volume of the third chambers remains constant throughout the work cycle.

29. A machine according to claim 28, characterized in that the machine is operable for absorption of mechanical energy (braking) by a valve device connected between the third chambers which upon braking restricts the working medium path between the third chambers and in that conduits connect each third chamber with a cooler, each such conduit including a valve which is operable to restrict the associated conduit to a selected degree, the valves being interconnected for simultaneous operation.

30. A machine according to claim 25, characterized in that the third chamber is connected to the cooler connected to the external coolant system, which cooler serves as a buffer volume.

31. A machine according to claim 30, characterized in that the secondary chamber and the third chamber are connected to each other by means of one or more conduits each of which contain a check valve which opens the connection between the said chambers when the pressure in the secondary chamber approaches or exceeds the pressure in the third chamber.

32. A machine according to claim 28 comprising two units, characterized in that a linear alternator is provided in the conduit interconnecting the third chambers to be operated by the working medium flowing between the third chambers.

33. A thermodynamic machine that may readily be controlled to give varying power output levels, comprising:

first and second piston-cylinder devices interconnected by regenerator means and operating in opposite phase relation, said first and second piston-cylinder devices including means for transferring working medium therebetween at substantially constant pressure during contraction of the volume of the first piston-cylinder device;

heater means coupled to the first piston-cylinder device;

plenum means providing a cool working medium at a predetermined working medium pressure;

controllable injection valve means coupled to the plenum means for providing working medium at the predetermined pressure to the first piston-cylinder device for a selectively variable initial portion of the expansion movement of the first piston-cylinder device, the pressure in the first piston-cylinder device thereafter decreasing, such that the timing of the closing of the injection valve means determines the work output of the machine by varying the ratio of the pressures in the machine during the expansion and contraction movements of the first piston-cylinder device; and the work output may be decreased substantially to zero by closing the injection valve means at substantially full expansion of the first piston-cylinder device.

34. The invention as set forth in claim 33 above, wherein said first and second piston-cylinder means have effective cross-sectional areas having substantially the same ratio as the mean absolute working temperatures of the first and second piston-cylinder devices.

35. The invention as set forth in claim 34 above, wherein the first and second piston-cylinder means comprise a common cylinder body and an intermediate reciprocating piston defining one end of oppositely varying volumes on the opposite sides thereof.

36. The invention as set forth in claim 33 above, wherein the injection valve means is coupled to open immediately after the start of expansion of the first piston-cylinder device and controllable to remain open for between 40% and 100% of the remainder of the expansion movement.

37. The invention as set forth in claim 36 above, including in addition exhaust valve means coupling the second piston-cylinder device to the plenum means, and coupled to open during contraction of the second piston-cylinder device when the pressure therein is substantially at predetermined working medium pressure and to remain open until the completion of the contraction movement of the second piston-cylinder device.

38. The invention as set forth in claim 37 above, including in addition transfer valve means coupling the first piston-cylinder device to the second piston-cylinder device through the regenerator during contraction of the first piston-cylinder device, the transfer valve means being coupled to be open during 50 to 100% of the contraction of the first piston-cylinder device, whereby to additionally control power output by varying the initial recompression of the working medium in the first piston-cylinder device.

39. A controllable work output hot gas engine of the type having a primary chamber for confining hot gas and a secondary chamber for confining cold gas, and a regenerator and heater coupled to the primary chamber, with the primary and secondary chamber volumes changing cyclically in opposite senses, characterized by:

plenum means providing a working pressure reservoir of cold gas;

injection means coupling the plenum means to the primary chamber through the regenerator and heater during a controllable part of the volume expansion portion of the primary chamber cycle, the interval of injection commencing approximately with volume expansion and continuing to 40% to 100% of the expansion and the primary chamber pressure decreasing between the termination of injection and the completion of volume expansion;

exhaust means coupling the plenum means to the secondary chamber for a controllable part of the volume compression portion of the secondary chamber cycle; and transfer valve means coupling the secondary chamber to the primary chamber for transfer of gas therebetween through the heater and regenerator when the volume of the primary chamber is decreasing, the secondary chamber and primary chamber having volumetric change rates proportioned to maintain the pressures therein substantially constant during gas transfer at a pressure level predetermined by the duration of the interval of injection, such that the work output of the engine may be controlled within a wide range, and reduced substantially to zero.

* * * * *